US005672049A

United States Patent [19]

Ciurlo

[11] Patent Number: 5,672,049

[45] Date of Patent: Sep. 30, 1997

[54] ELECTROMECHANICAL DEVICE FOR THE PROTECTION OF A PUMP IN WATERWORKS OF VARIOUS TYPES, IN THE ABSENCE OF WATER

[76] Inventor: Ugo Ciurlo, Via di Moriano No. 1625, 55100 Monte San Quirico, Lucca, Italy

[21] Appl. No.: 233,354

[22] Filed: Apr. 26, 1994

[30] Foreign Application Priority Data

Apr. 28, 1993 [IT] Italy ..... LU/93/A/5

[51] Int. Cl.[6] ..... F04B 49/06

[52] U.S. Cl. ..... 417/44.1; 417/44.2; 417/44.9; 417/12; 200/81.9 R; 200/83 J

[58] Field of Search ..... 417/44.2, 44.4, 417/44.9, 12; 200/81.9 R, 83 J

[56] References Cited

U.S. PATENT DOCUMENTS

| | | | |
|---|---|---|---|
| 2,118,130 | 5/1938 | Aikman | 417/44.9 |
| 2,554,266 | 5/1951 | Pauly | 200/83 J |
| 3,106,894 | 10/1963 | Johnsen | 417/44.2 |
| 3,139,493 | 6/1964 | Krieger, Sr. et al. | 200/81.9 R |
| 3,143,969 | 8/1964 | Eames et al. | 417/44.9 |
| 3,235,683 | 2/1966 | Beeman | 417/44.9 |
| 3,738,776 | 6/1973 | Debare | 417/44.9 |
| 4,118,148 | 10/1978 | Allen | 417/44.2 |
| 4,200,775 | 4/1980 | Bodnar . | |
| 4,215,254 | 7/1980 | Ohki | 200/83 J |
| 4,848,097 | 7/1989 | Roberts | 417/44.9 |
| 5,292,232 | 3/1994 | Krohn et al. | 417/44.2 |
| 5,320,280 | 6/1994 | Murphy et al. | 200/81.9 R |

*Primary Examiner*—Timothy Thorpe
*Assistant Examiner*—Ted Kim
*Attorney, Agent, or Firm*—McGlew And Tuttle

[57] ABSTRACT

The device comprises: a branch (5) from the outlet (M) of the pump to a cavity (7) partially delimited by a membrane (14); a moving element (16, 22, 24) in a casing (9); a spring (36) pushing said element (16, 22, 24) toward the membrane (14) and capable of yielding under the action of a relatively restricted pressure of the water which reaches said cavity (7) and acts on the membrane; and moving electrical contacts (26) on said element (16, 22, 24), interacting with fixed contacts (28) of a supply circuit of the pump, to enable the pump to be switched on and to switch it off in the absence of pressure acting on the membrane (14).

15 Claims, 3 Drawing Sheets

ELECTROMECHANICAL DEVICE FOR THE PROTECTION OF A PUMP IN WATERWORKS OF VARIOUS TYPES, IN THE ABSENCE OF WATER

FIELD OF THE INVENTION

The invention relates to an electromechanical device capable of automatically checking the presence of water in a domestic distribution circuit of a building, of an industrial installation or other, for the protection of the circulating pump of the circuit.

BACKGROUND OF THE INVENTION

There are known mechanical or electronic devices, which, when installed in various types of waterworks, provided with a pressure and capacity stabilizing system, check the constant presence of water within a supply network, but these present problems particularly when the flow of water becomes insufficient. In this case the installed device, which no longer detects the presence of water owing to a lack of pressure or flow, sends the starting input to the corresponding pump of the plant, designed to keep the internal pressure constant, in order to reach a minimum level for correct usage. The pump continues to run until the necessary conditions for optimal operation are re-established, or the correct internal pressure is reached. Consequently, when there is insufficient water in the town supply network or in the cistern, and therefore in the absence of water flow in the corresponding plant, the pump continues to operate, obviously without a load, with a serious risk of damage to the pump.

Other problems may arise simply from the presence of electronic devices, which, moreover, are not always reliable or easily understood for correct installation by all hydraulic engineers.

SUMMARY AND OBJECTS OF THE INVENTION

In order to avoid and eliminate the problems mentioned above, without altering in any way the installation system or the operating characteristics of the waterworks in general, the electromechanical device to which the invention relates has been developed, and is easily understood, simply fitted and highly reliable, particularly in wet areas such as those where these gadgets are fitted. The device protects the pump from damage due to a lack of water flow through the pump.

Substantially, the electromechanical device according to the invention (for protecting the pump in case of accidental absence of water) comprises: a branch from the outlet of the pump to a cavity formed in a base and partially delimited by a membrane trapped between the base and a casing; a moving element in the casing joined to said base; spring means pushing said element toward the membrane and capable of yielding under the action of even a relatively modest pressure of the water which reaches the cavity and acts on the membrane; moving electrical contacts on the element, interacting with fixed contacts of a supply circuit of the pump, to enable the pump to be switched on and to switch it off in the absence of pressure acting on the membrane.

The moving element is also provided with a member for manual operation, particularly for turning the pump on.

The moving contacts may be elastic and capable of bridging pairs of corresponding fixed contacts. The moving contacts may be carried by a cross-piece of the moving element.

The device in question may be fitted, in the outlet pipe of the pump at the inlet of a waterworks in combination with a pressure stabilizing gadget which, in turn, controls the pump used for distributing the water necessary for the maintenance of the internal pressure and of the water capacity.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
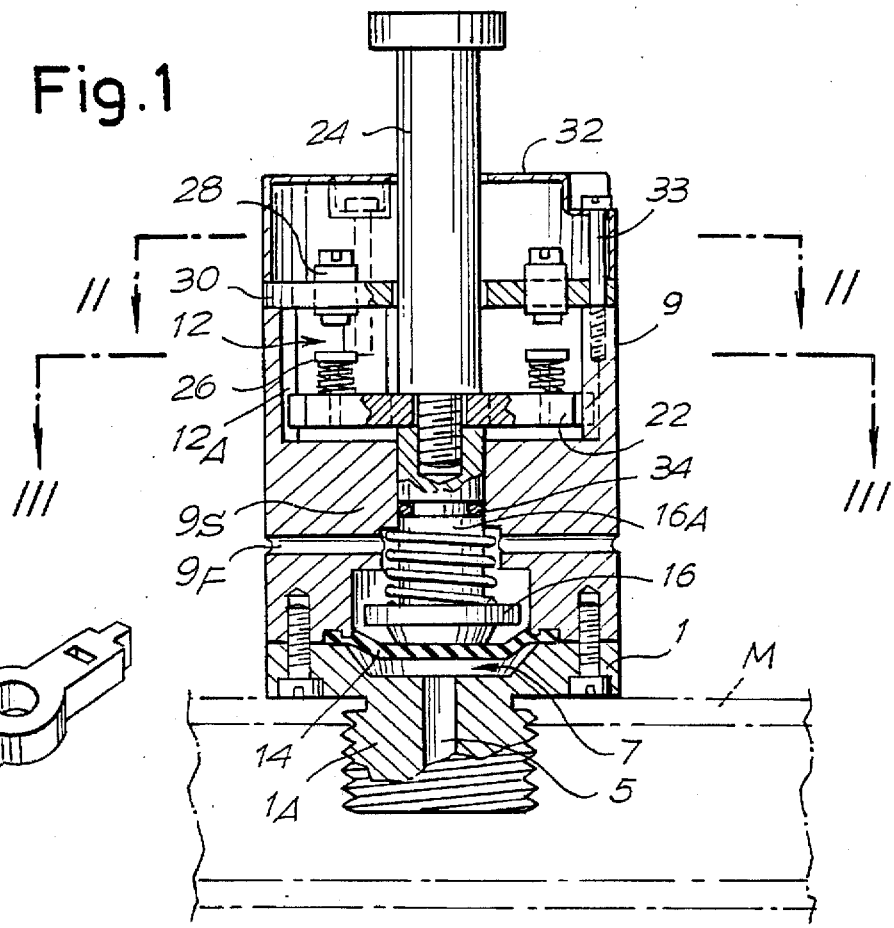
FIG. 1 shows a complete axial section.
Figure 5:
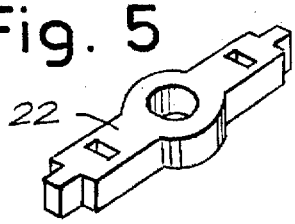
FIG. 5 shows a contact support cross-piece in perspective.
Figure 2:
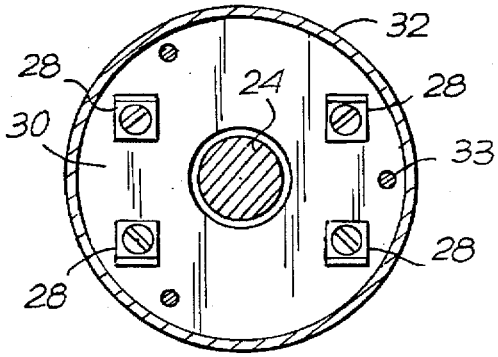
FIGS. 2 and 3 show a section through II—II of FIG. 1 and a partial view from the line III—III of FIG. 1.
Figure 3:
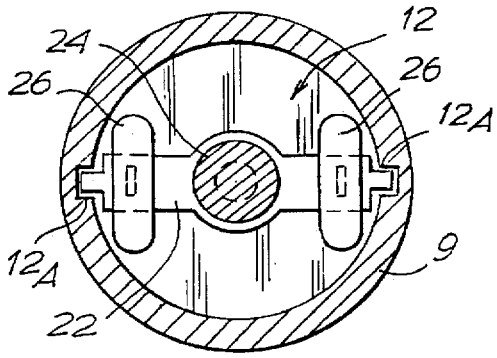
Figure 4:
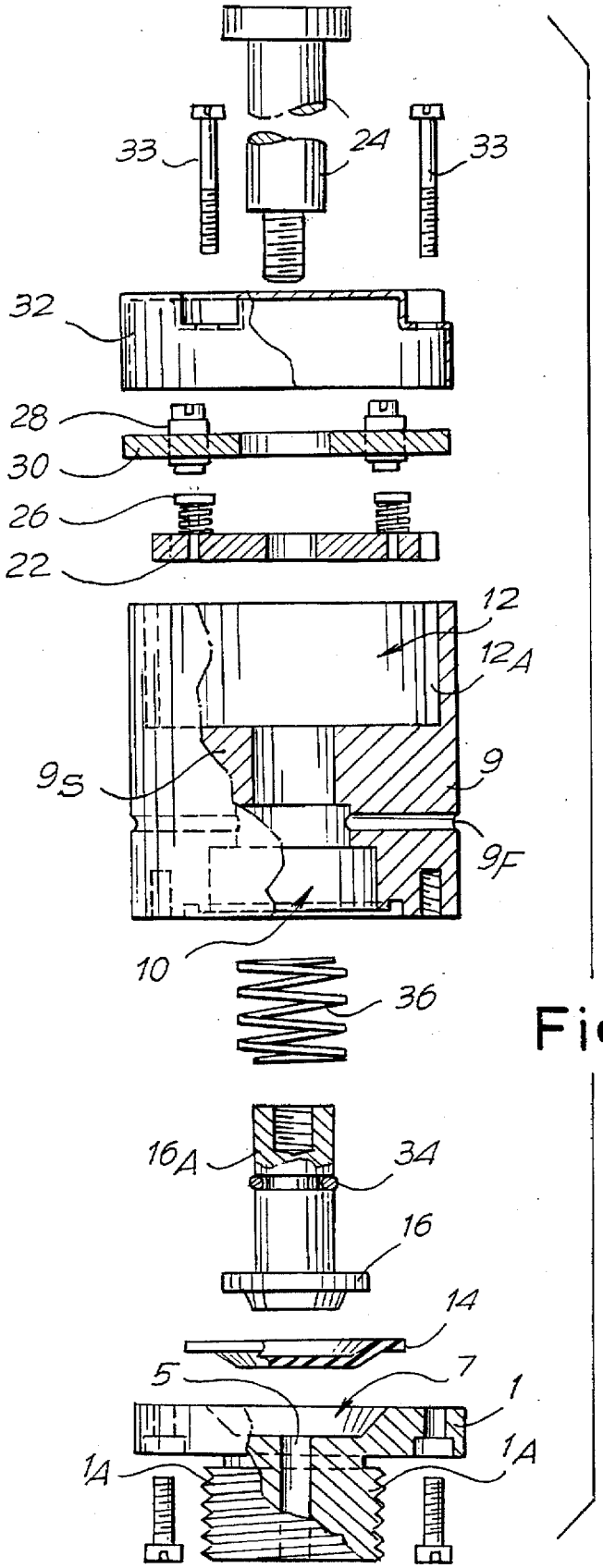
FIG. 4 shows the components in an exploded view in at least partial section.

In the drawing, the number 1 indicates a base, with a union 1A for branching from an outlet pipe M, illustrated schematically in FIG. 1; a hole 5 in the union 1A enables water from the pipe M to enter a cavity 7 in the base 1. The number 9 indicates a body forming a casing, which has a through cavity shaped to form a first lower cylindrical chamber 10 and a second upper chamber 12. The base 1 and the casing 9 are joined by pressing a flexible membrane or diaphram 14 peripherally to form a seal. The chamber 10 houses a piston 16 forming part of a moving element which comprises, in addition to the piston 16, and fixed to its rod 16A, an insulating contact support cross-piece 22 and an operating member 24; the members 16, 22, 24 form a moving or movable element. The cross-piece 22 is located in the upper chamber 12 and is guided by longitudinal grooves 12A in the the chamber. The cross-piece 22 carries two transverse elastically movable contacts 26. Each of the two contacts 26 can interact with two fixed contacts 28 connected to external connecting terminals; the contacts 28 are supported by-a cover 30; A cap 32 may close off the chamber 12 and the space occupied by the terminals of the fixed contacts 28. The cover 30 and the cap 32 are fixed with screws 33 to the casing 9. The rod 16A passes through a thick diaphragm 9S, which separates the chambers 10 and 12. The control member 24, which may be screwed into the end of the rod 16A from the outside, passes through the cover 30 and the cap 32. An annular seal 34, such as a so-called O-ring 34, acts between the diaphragm 9S and the rod 16A, and is housed in an annular channel of the rod 16A or of the diaphragm 9S, to prevent the passage of water to the chamber 12. A spring 36 surrounding the rod 16A of the piston 16 acts on the diaphragm 9S and pushes the piston 16 against the membrane 14.

The device is fixed to the piping M of the water supply network by means of the union 1A of the base 1. The hole 5 enables the cavity 7 to communicate with the pipe M, so that the pressure prevailing in this pipe acts on the membrane 14, which in turn pushes the piston 16 and the whole element 16, 22, 24, including the contacts 26, against the action of the spring 36. To ensure that the whole element 16, 22, 24 can move, and that the water is discharged from the chamber 10, the casing 9 has one or more small-diameter holes 9F in its sides, for the drainage of the water which may be filtered or pass by the membrane 14, and to avoid impeding the reduction in volume of the chamber 10.

Under normal conditions, the water contained in any waterworks reaches the cavity 7 through the hole 5. The pressure of the water, even if low, acts on the membrane 14 and lifts it, overcoming the counterthrust of the spring 36. Consequently, the piston 16 and the whole element 16, 22, 24 and the contacts 26 are also lifted. Under this condition, each of the two moving contacts 26, modulated by the respective spring, touches one of the respective two fixed contacts 28, so that the electrical circuit means is closed and, consequently, the starting input is delivered to the plant pump designed to maintain the appropriate pressure for the correct use of the plant. This operation is executed at pressures of the order of as little as 0.3–0.5 bar and for as long as pressure is maintained in the cavity 7. If there is insufficient water in the waterworks, the water contained in the cavity 7 flows out through the hole 5, causing the piston 16 to descend together with the contact support cross-piece 22 with the moving contacts 26, which are moved away from the fixed contacts of the circuit means 28. The electrical contacts therefore cut off the supply of electricity to the pump which stops until the water returns to normal levels within the water distribution network.

The external operation member 24 enables the element 16, 22, 24 and consequently the contact support cross-piece 22 to be lifted manually even when the water has not returned to the waterworks, or when operation of the pump is required for other purposes.

Figure 6:
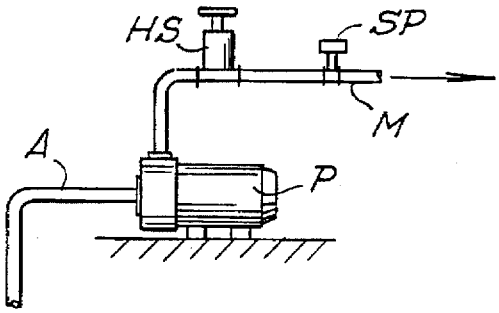
FIGS. 6, 7 and 8 show three possible installation diagrams.
Figure 7:
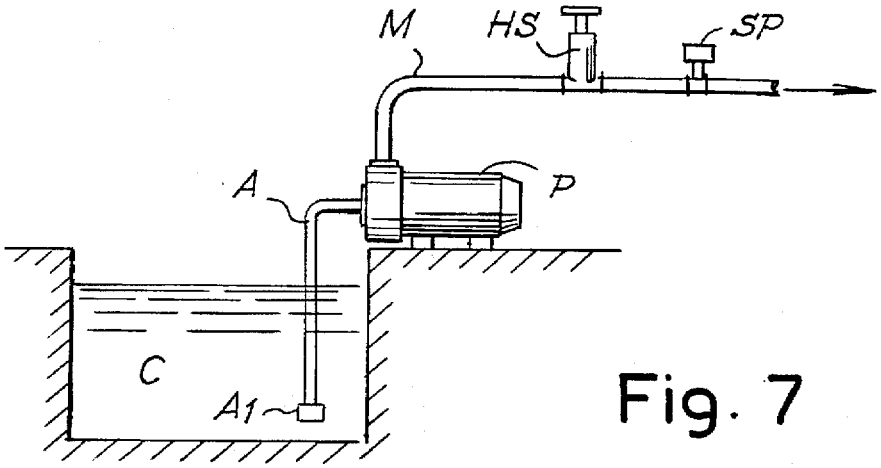
Figure 8:
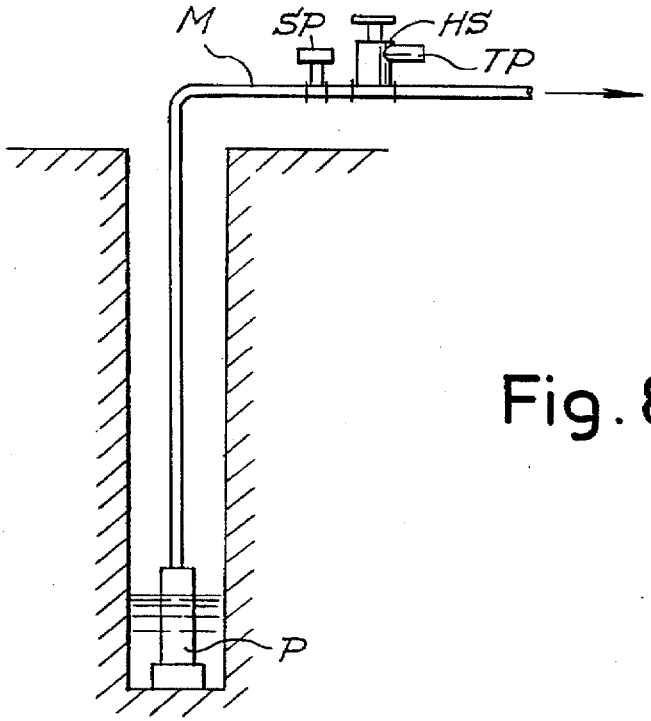

FIGS. 6, 7 and 8 show three possible types of installation of the device, indicated here in a general way by HS; P indicates the pump protected by it, M indicates the outlet to the consumer and A indicates the inlet of the pump P. A pressure stabilizer SP may advantageously interact with the device HS.

In FIG. 6 there is a direct connection to the water distribution network. When there is insufficient water in the network, the operation of the pump is interrupted. When network pressure returns, the device HS is automatically reset by the thrust of the water on the membrane 14.

In FIG. 7, the pump has its inlet A and a one-way valve A1 immersed in a storage tank or cistern C. When there is insufficient water in the cistern C, the operation of the pump is interrupted, and it is necessary to reset it manually; as soon as the water level is regained in C, the device HS may be manually reset; the resetting operation takes only a few seconds if the pump P has its one-way valve A1.

When the pump is located in a deep well and no longer delivers water (FIG. 8), the pressure falls in the delivery pipe M and the device HS turns the pump off; if the stoppage was due to causes other than a lack of water—for example, obstructions caused by mud, sand, or other matter—the manual resetting does not restore normal operation, the resetting may be repeated one or more times before giving up and intervening to remove the causes. In this solution, it is also possible to provide a timer TP to automate the resetting attempts. The timer may be activated by auxiliary contacts acting in the lowered position of the cross-piece.

In a general way, the device HS may be adjusted to switch off when the water pressure is lower than 0.3/0.5 bar. If the pressure returns naturally (water main) the device is automatically reset, while in cases in which the pump is immersed, the resetting will be manual or electronically controlled with the corresponding intervention of the timer.

The device is extremely simple in mechanical terms and resolves in an optimal manner all the problems which have hitherto resulted in considerable inconvenience and economic losses.

I claim:

1. A pump protection device comprising:

a housing defining first and second chambers, said first chamber being in communication with a flow of a pump;

a diaphragm positioned across said first chamber;

a movable element having a first portion in contact with said diaphragm, said movable element having a second portion extending from said first chamber into said second chamber;

a spring means for biasing said movable element against said diaphragm;

electrical circuit means positioned in said second chamber and for interacting with said second portion of said movable element to determine when a pressure of the flow is an insufficient pressure for the pump to operate, said electrical circuit means blocking operation of the pump when said pressure is insufficient;

an annular seal positioned around said second portion of said movable element to form a seal between said first chamber and said second chamber.

2. A device in accordance with claim 1, wherein:

said diaphragm divides said first chamber into first and second portions, said first portion of said chamber being in communication with said flow;

said housing defining through passages for communication of said second portion of said chamber with a surrounding environment of said housing.

3. A device in accordance with claim 1, wherein:

said spring means is positioned in said first chamber.

4. A device in accordance with claim 1, wherein:

said movable element includes manual means for manually operating said electrical circuit means, said first and second portions of said movable element and said manual means passing through said first and second chambers.

5. A pump protection device comprising:

a housing defining first and second chambers, said first chamber being in communication with a flow of a pump;

a diaphragm positioned across said first chamber;

a movable element having a piston in contact with said diaphragm, said movable element having a piston rod extending through said first chamber and said second chamber;

a spring means positioned in said first chamber and for biasing said movable element against said diaphragm;

electrical circuit means for interacting with another portion of said movable element to determine when a pressure of the flow is an insufficient pressure for the pump to operate, said electrical circuit means blocking operation of the pump when said pressure is insufficient, said electrical circuit means including fixed contacts on said housing and movable contacts on said movable element, said fixed and movable contacts being positioned in said second chamber;

an annular seal positioned around said piston rod to form a seal between said first chamber and said second chamber.

6. A device in accordance with claim 5, wherein:

said housing includes a casing and a base with a branch connected to an outlet of the pump;

said diaphragm partially delimits said first chamber, said diaphragm being positioned between said casing and said base;

said spring means yielding said diaphragm when said pressure of said flow is greater than said insufficient pressure;

said movable contacts being in electrical contact with said fixed contacts when said pressure of the flow is sufficient, said electrical circuit means enabling the pump to be switched on when said pressure of the flow is greater than said insufficient pressure, said electrical circuit means switching the pump off when said pressure of the flow is less than or equal to said insufficient pressure.

7. A device in accordance with claim 6, wherein:

each of said movable contacts are elastically mounted and bridging pairs of said fixed contacts.

8. A device in accordance with claim 6, wherein:

said movable element includes a cross-piece;

said casing defines longitudinal grooves for guiding said cross-piece.

9. A device in accordance with claim 5, wherein:

said diaphragm divides said first chamber into first and second portions, said first portion of said chamber being in communication with said flow and said second portion of said chamber being in communication with a surrounding environment of said housing through passages defined by said housing.

10. A device in accordance with claim 5, wherein:

said movable element includes manual means for manually operating said electrical circuit means.

11. A device in accordance with claim 10, further comprising:

a timer means for enabling operation of the pump for a predetermined period after said manual means is activated.

12. A device in accordance with claim 5, wherein:

said electrical circuit means enables standard operation of the pump when said pressure of the flow is greater than said insufficient pressure.

13. A device in accordance with claim 12, wherein:

standard operation of the pump includes a pressure stabilizer.

14. A device in accordance with claim 5, wherein:

said movable element includes manual means for manually enabling operation of the pump.

15. A pump protection device comprising:

a housing defining a chamber in communication with a flow of a pump, said housing including a casing and a base with a branch connected to an outlet of the pump;

a diaphragm positioned across said chamber, said diaphragm partially delimiting said chamber, said diaphragm being positioned between said casing and said base;

a movable element having a portion in contact with said diaphragm;

a spring means for biasing said movable element against said diaphragm, said spring means yielding said diaphragm when a pressure of said flow is greater than an insufficient pressure for the pump to operate;

electrical circuit means for interacting with another portion of said movable element to determine when said pressure of the flow is said insufficient pressure, said electrical circuit means blocking operation of the pump when said pressure is insufficient, said electrical circuit means including fixed contacts on said housing and movable contacts on said movable element, said movable contacts being in electrical contact with said fixed contacts when said pressure of the flow is sufficient, said electrical circuit means enabling the pump to be switched on when said pressure of the flow is greater than said insufficient pressure, said electrical circuit means switching the pump off when said pressure of the flow is less than or equal to said insufficient pressure;

said casing defines another chamber which includes said movable and fixed contacts;

said movable element includes a piston positioned in said chamber and a rod extending from said piston to said another chamber;

an annular seal positioned around said rod to form a seal between said chamber and said another chamber.

* * * * *